United States Patent [19]

Reiling et al.

[11] Patent Number: 4,547,999

[45] Date of Patent: Oct. 22, 1985

[54] DEVICE FOR FIXING A DRILL TO BE GROUND

[76] Inventors: Karl Reiling, Pforzheimer Strasse 28; Reinhold Reiling, Gründeltorstrasse 9, both of D-7539 Kämpfelbach-Ersingen, Fed. Rep. of Germany

[21] Appl. No.: 442,297

[22] Filed: Nov. 17, 1982

[30] Foreign Application Priority Data

Nov. 25, 1981 [DE] Fed. Rep. of Germany ..... 3146664

[51] Int. Cl.[4] ..... B24B 3/26

[52] U.S. Cl. ..... 51/219 R

[58] Field of Search ..... 51/219, 217, 288; 269/71, 246, 251, 287

[56] References Cited

U.S. PATENT DOCUMENTS

| | | | |
|---|---|---|---|
| 2,356,591 | 8/1944 | Jesionowski | 269/246 |
| 2,932,924 | 4/1960 | Zachow | 51/219 R |
| 4,002,328 | 1/1977 | Wolf et al. | 269/246 |
| 4,270,315 | 6/1981 | Reiling et al. | 51/219 R |
| 4,405,120 | 9/1983 | Kober | 269/246 |

*Primary Examiner*—Harold D. Whitehead

*Attorney, Agent, or Firm*—Balogh, Osann, Kramer, Dvorak, Genova & Traub

[57] ABSTRACT

This invention relates to a fixing device for fixing drills which are to be ground at their cutting edges. The fixing device comprises a baseplate, a stand carried by said baseplate, a pivot pin mounted on said stand near its top end, and a gripping device, which is slidably fitted on said pivot pin and adapted to grip the drill which is to be ground. The invention provides a simple and inexpensive fixing device of this type, which can be used for grinding twist drills or other drills, particularly by hobbyists, with adequate accuracy.

In a device for fixing a drill which is to be ground at its cutting edges, comprising a baseplate, a stand carried by said baseplate, a pivot pin mounted on said stand near its top end, and a gripping device, which is fitted on said pivot pin and adapted to grip the drill which is to be ground, wherein said gripping device comprises a retaining member and prismatic members which extend transversely to said retaining member and are adapted to be adjusted relative to each other and to be fixed in position, a web of said retaining member carries a thrust screw for gripping a drill disposed between the prismatic members, and the prismatic members have end faces formed with blind bores for a fitting of the prismatic members on said pivot pin in different positions, that object is accomplished according in that the retaining member consists of a U-shaped guiding member, which embraces the prismatic members and extends into grooves formed on opposite sides of said prismatic members, one of said prismatic members constitutes an outer prismatic member, which is crew-connected to the end portions of the legs of the retaining member, the other of said prismatic members constitutes an inner prismatic member and is adapted to be displaced by said thrust screw so as to grip the drill between the prismatic members, and the prismatic members are formed in confronting surfaces with respective U-shaped longitudinal grooves, which are adapted to receive the drill.

1 Claim, 2 Drawing Figures

DEVICE FOR FIXING A DRILL TO BE GROUND

BACKGROUND OF THE INVENTION

1. Field of the Invention

This invention relates to a device for fixing a drill which is to be ground at its cutting edges, comprising a baseplate, a stand carried by said baseplate, a pivot pin mounted on said stand near its top end, and a gripping device, which is slidably fitted on said pivot pin and adapted to grip the drill which is to be ground.

2. Description of Prior Art

Such devices for fixing twist drills which are to be ground at their cutting edges are known from German Patent Specification No. 2833420 and comprise a baseplate, on which a carriage is slidably mounted to be movable in a horizontal direction by a screw. The carriage carries a stand, which is pivoted to the carriage on a vertical axis and near its top end carries a horizontal pivot pin, on which a device for gripping the drill to be sharpened is pivoted. The carriage has a tapped vertical bore, into which a clamping screw has been screwed, which extends through a slot formed in a baseplate of the angled stand. That screw serves to hold the stand in position. The baseplate is L-shaped and has an upwardly directed leg, which is formed with a clamping eye for receiving a bearing neck of a hand drill. In accordance with Laid-open German Application No. 2915601 for a patent of addition to German Pat. No. 2833420 the gripping device comprises two comblike gripping jaws, the teeth of which interengage and which are movable relative to each other by a clamping screw. Each gripping jaw is provided at that end which is adjacent to the stand with a wedge-shaped extension, which tapers toward the tip of the drill to be gripped, and with a bore, with which the gripping jaw can be fitted in different positions on the horizontal pivot pin. The extension of each gripping jaw comprises prism surfaces and the gripping jaws of the gripping device are displaceable relative to each other by means of transversely extending guide pins provided on a lateral retaining bar. The clamping screw is in screw-threaded engagement with the retaining bar.

It has been found that that device can be used for work requiring very high precision but the parts of said device must be made with high precision and closely matched so that the device is expensive and mainly suitable for commercial operations.

SUMMARY OF THE INVENTION

It is an object of the invention to provide a simpler and less expensive fixing device which is of the kind described first hereinbefore and can be used in the grinding of drills, particularly of twist drills, with adequate accuracy by hobbyists.

In a device for fixing a drill which is to be ground at its cutting edges, comprising a baseplate, a stand carried by said baseplate, a pivot pin mounted on said stand near its top end, and a gripping device, which is fitted on said pivot pin and adapted to grip the drill which is to be ground, wherein said gripping device comprises a retaining member and prismatic members which extend transversely to said retaining member and are adapted to be adjusted relative to each other and to be fixed in position, a web of said retaining member carries a thrust screw for gripping a drill disposed between the prismatic members, and the prismatic members have end faces formed with blind bores for a fitting of the prismatic members on said pivot pin in different positions, that object is accomplished according in that the retaining member consists of a U-shaped guiding member, which embraces the prismatic members and extends into grooves formed on opposite sides of said prismatic members, one of said prismatic members constitutes an outer prismatic member, which is screw-connected to the end portions of the legs of the retaining member, the other of said prismatic members constitutes an inner prismatic member and is adapted to be displaced by said thrust screw so as to grip the drill between the prismatic members, and the prismatic members are formed in confronting surfaces with respective V-shaped longitudinal grooves, which are adapted to receive the drill. The prismatic members are preferably formed in opposite side faces with different V-shaped longitudinal grooves so that drills differing in diameter can be fixed.

BRIEF DESCRIPTION OF THE DRAWINGS

Further details of the fixing device according to the invention will be explained with illustrative embodiments which are shown on the accompanying drawings, in which.

DESCRIPTION OF THE PREFERRED EMBODIMENTS

Figure 1:
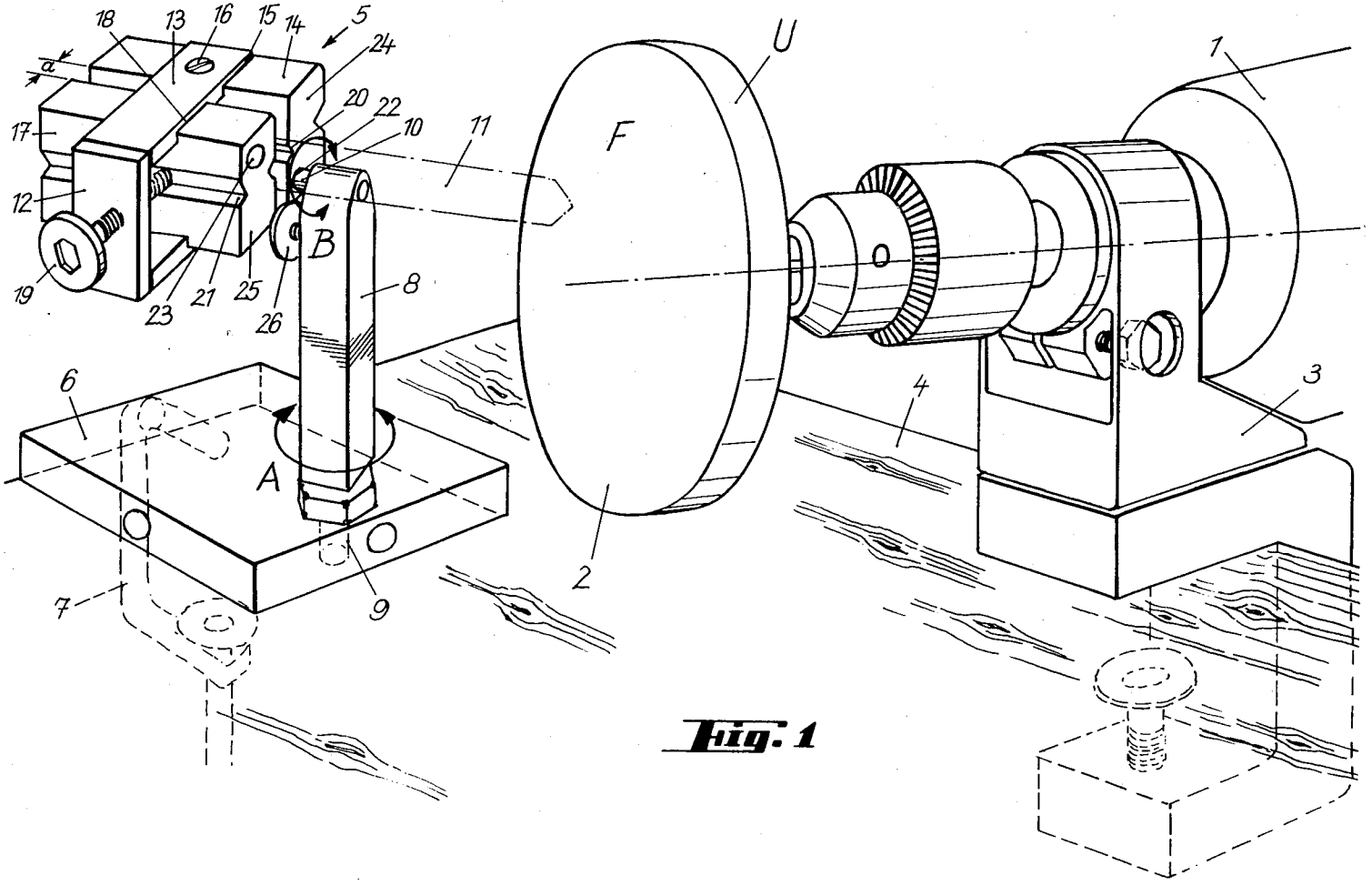
FIG. 1 is a perspective view showing a device for use in grinding a twist drill on a hobbyist's machine and FIG. 2 is a perspective view showing a device for use in grinding a twist drill on a grinding stand.

In the first embodiment shown in FIG. 1, a hobbyist's machine 1 is provided with a grinding wheel 2 and is secured to a bench 4 by means of a clamp 3. The fixing device according to the invention is associated with the machine 1 and comprises a baseplate 6, which is held on the bench 4 by a clamp 7. The baseplate 6 carries the stand 8, which by means of a screw 9 is mounted on the baseplate 6 and can be angularly and vertically adjusted relative to the baseplate 6 and secured in position. The stand 8 carries a pivot pin 10, which extends at right angles to the stand 9. The gripping device 5 is fitted on the pivot pin 10 and adapted to grip the drill 11 which is to be ground. The gripping device 5 comprises a U-shaped guiding member 12. A first or outer prismatic member 14, which is formed with channel-shaped grooves 15 on opposite sides has been slidably inserted between the leg end portions 13 of U-shaped guiding member 12 so as to extend transversely thereto and has been fixed to the guiding member 12 by screws 16. A second or inner prismatic member 17 is formed with channel-shaped grooves 18 on opposite sides and has been slidably inserted between the legs of guiding member 12 so as to extend transversely thereto and is spaced on adjustable distance a from the first prismatic member 14. A thrust screw 19 is in screw-threaded engagement with the web of the guiding member 12 and when the drill 11 has been placed between the prismatic members 14 and 17 said thrust screw 19 is operated to fix the drill 11 in position in the U-shaped longitudinal grooves 20 formed in the confronting side faces of the prismatic members 14 and 17, which are formed in the side faces which are opposite to the confronting side faces with U-shaped longitudinal grooves 21, which differ in cross-section from the grooves 20 so that drills differing in diameter can be held between the prismatic members 14 and 17 when the latter are properly positioned. The prismatic members 14 and 17 are formed in their end faces 24, 25 with blind bores 22, 23 for fitting the gripping device 5 on the pivot pin 10 in different positions. In the present embodiment, the end faces 24 and 25 of the prismatic members 14 and 17 extend at right angles to the axis of the longitudinal groove 20. The stop screw 26 provides an adjustable depth-limiting stop for the prismatic members 14 and 17. By a rotation of the stand 8 in the directions indicated by the double-headed arrow A, the drill 11 can be positioned for engagement with the end face F or the peripheral surface U of the grinding wheel 2. The gripping device 5 can be pivotally moved in the directions indicated by the double-headed arrow B so that the drill 11 can be ground on one side near its point. When the gripping device has been fitted on the pivot pin 10 in a different position with the blind holes 22, 23, the drill 11 can be ground on the other side.

Figure 2:
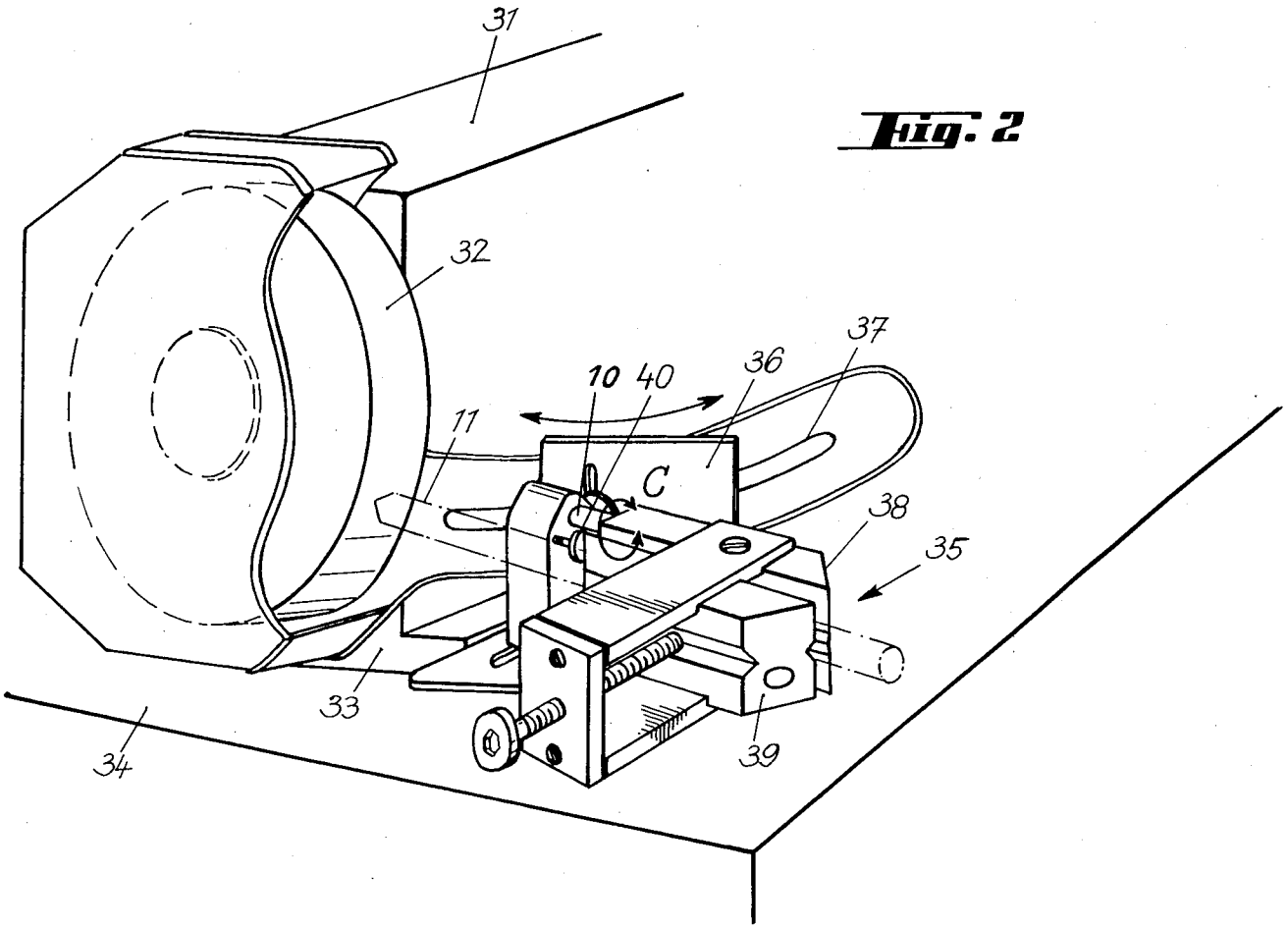

In the second embodiment shown in FIG. 2, the fixing device according to the invention is used in the grinding of drills in conjunction with a grinding wheel stand 31, which has a base 33 secured to a bench 34 and carries a grinding wheel 32. The fixing device comprises an L-shaped baseplate 36, which is adjustably mounted in the guide slot 37 formed in the grinding wheel stand 31. Otherwise, the guiding slot 37 of the grinding wheel stand 31 serves for the fixation of the grinding rest, which has been removed here. In other respects, the gripping device 35 corresponds to the gripping device 5 shown in FIG. 1 and the fixing device shown in FIG. 2 comprises parts corresponding to parts 12 to 23 shown in FIG. 1. The drill 11 to be ground is indicated too. In the embodiment shown in FIG. 2, the end faces 38, 39 of the prismatic members extend at an oblique angle to the longitudinal axis of the respective prisms so that owing to the cooperation of said end faces with the adjustable stop screw 40 the pivotal movement in the directions indicated by the double-headed arrow C will result in a helical movement of the drill 11 during the grinding operation. But in the embodiment shown in FIG. 2, the end faces of the prismatic members may extend at right angles to the longitudinal axes of said prismatic members, as is shown in FIG. 1.

We claim:

1. In a fixed device for fixing a drill having cutting edges which are to be ground by a grindstone face, said fixing device comprising a baseplate;

a stand mounted on and extending above said baseplate;

a pivot pin mounted on said stand and extending above said baseplate transversely to the vertical direction; and a gripping device which is slidably fitted on said pivot pin and adapted to grip a drill which is to be ground, said gripping device comprising an elongated retaining member and two prismatic members which are carried by said retaining member and extend transversely thereto and are slidable relative to each other, each of said prismatic members having mutually opposite end faces formed with respective blind bores, each of which is adapted to slidably receive said pivot pin, said prismatic members being adapted to receive between them a drill to be ground, said gripping device also comprising a thrust screw, which is carried by said retaining member and operable to engage one of said prismatic members on the side which is opposite to the other of said prismatic members and to force said one prismatic member toward the other and against a drill disposed between said prismatic members so as to grip said drill and to fix said prismatic members in position relative to each other, the improvement residing in that said retaining member is U-shaped and comprises two legs and a web connecting said legs, said two prismatic members have confronting side faces formed with registering V-shaped longitudinal grooves adapted to receive portions of a drill disposed between said prismatic members, said prismatic members have mutually opposite side faces formed with grooves for receiving said legs of said retaining member, said prismatic members have side faces which are opposite to said confronting side faces and formed with V-shaped longitudinal grooves differing in cross-section from said longitudinal grooves in said confronting side faces, said one prismatic member being an inner member which is disposed between said web and said other prismatic member, which is an outer member, said legs of said retaining member carry screw means by which said outer prismatic member is secured to said legs, and said thrust screw is in screw-threaded engagement with said web and in engagement with said inner member to make it shiftable toward said outer member to clamp said drill, said prismatic members are adapted to be mounted in said retaining member and on said pivot pin in such a manner that said opposite side faces face each other and said longitudinal grooves therein register with each other so that said prismatic members are adapted to grip between them drills differing in diameter, and an adjustable stop member is carried by and in screw-threaded engagement with said stand and extends parallel to said pivot pin and is engageable by the end faces of said prismatic members to limit the movement thereof axially along said pivot pin, whereby the limited rotation of said retainer member about said pivot pin, as determined by the movement of the drill with respect to the stand, defines an orbital path along which the cutting edges of the drill will move across the grindstone face.

* * * * *